US008920207B2

(12) United States Patent
Hageman et al.

(10) Patent No.: US 8,920,207 B2
(45) Date of Patent: Dec. 30, 2014

(54) BLOCK TOY PLAYSET WITH DYNAMIC BUILDING SURFACE

(75) Inventors: Beth Ann Hageman, Orchard Park, NY (US); Gerald A. May, Colden, NY (US); Patrick Ritossa, Chesterland, OH (US)

(73) Assignee: Mattel, Inc., El Segundo, CA (US)

( * ) Notice: Subject to any disclaimer, the term of this patent is extended or adjusted under 35 U.S.C. 154(b) by 842 days.

(21) Appl. No.: 12/570,303

(22) Filed: Sep. 30, 2009

(65) Prior Publication Data

US 2011/0076909 A1 Mar. 31, 2011

(51) Int. Cl.
*A63H 33/08* (2006.01)
*A63H 33/04* (2006.01)

(52) U.S. Cl.
CPC ..... *A63H 33/042* (2013.01); *A63H 33/086* (2013.01)
USPC ..... 446/124; 446/102; 446/118

(58) Field of Classification Search
CPC ..... A63H 29/00; A63H 29/04; A63H 33/00; A63H 33/04; A63H 33/042; A63H 33/08; A63H 33/086; A63H 33/088; A63H 33/12; A63H 33/103; A63H 33/108
USPC ..... 446/1, 85, 102, 103, 118, 120–124, 489
See application file for complete search history.

(56) References Cited

U.S. PATENT DOCUMENTS

| | | | | |
|---|---|---|---|---|
| 1,615,925 | A | 5/1926 | Yancey | |
| 2,837,862 | A * | 6/1958 | Cleveland | 446/1 |
| 3,521,764 | A * | 7/1970 | Loomis | 206/386 |
| 4,226,045 | A * | 10/1980 | Lehmann et al. | 446/101 |
| 4,508,348 | A | 4/1985 | Lapointe | |
| D280,219 | S | 8/1985 | Suzuki | |
| 4,804,348 | A * | 2/1989 | Bondi' | 446/83 |
| 4,864,879 | A | 9/1989 | Hou | |
| 4,897,066 | A | 1/1990 | Tapdrup et al. | |
| 4,919,635 | A | 4/1990 | Bertrand | |
| 4,939,944 | A * | 7/1990 | Hou | 74/49 |
| 4,998,903 | A * | 3/1991 | Bolli et al. | 446/102 |
| 5,098,102 | A | 3/1992 | Cooper | |
| 5,238,407 | A | 8/1993 | Pollock | |
| 5,361,186 | A * | 11/1994 | Tanie et al. | 361/191 |
| 5,733,168 | A * | 3/1998 | Poulsen et al. | 446/120 |
| 5,779,515 | A * | 7/1998 | Chung | 446/90 |
| 6,162,108 | A | 12/2000 | Frederiksen | |
| 6,443,796 | B1 * | 9/2002 | Shackelford | 446/91 |
| 6,491,562 | B1 * | 12/2002 | Jackson | 446/71 |
| 6,893,316 | B2 * | 5/2005 | Maxwell et al. | 446/103 |
| 7,018,210 | B2 | 3/2006 | Goldman et al. | |

FOREIGN PATENT DOCUMENTS

| | | | |
|---|---|---|---|
| DE | 10304092 | | 8/2004 |
| DE | 10304092 | A1 * | 8/2004 |
| WO | WO 2009047225 | A1 * | 4/2009 |

* cited by examiner

*Primary Examiner* — Gene Kim
*Assistant Examiner* — Alyssa Hylinski
(74) *Attorney, Agent, or Firm* — Edell, Shapiro & Finnan, LLC

(57) ABSTRACT

The present invention is directed toward a toy building block system that includes a building portion having a housing with a surface and a building component. The building component is extendable from the housing and movable relative to the housing surface. The building component and the housing surface define a configuration of the building portion that is changeable during play. The toy building block system further includes a play component which is engageable with the building component.

25 Claims, 12 Drawing Sheets

BLOCK TOY PLAYSET WITH DYNAMIC BUILDING SURFACE

FIELD OF THE INVENTION

The present invention relates to a toy building playset and, in particular, to a playset including a reconfigurable building surface and one or more blocks that connect to the surface.

BACKGROUND OF THE INVENTION

Children enjoy playing with building or stacking block systems. Typical systems include a building surface and a series of blocks. The building surface may include a male connector that mates with a female receptacle on a block. The connection of these systems, however, is static. Thus, it would be desirable to provide a building system that includes a dynamic building surface to enhance the enjoyment of children playing with the system.

SUMMARY OF THE INVENTION

The present invention is directed toward a building system including a building portion and a one or more building blocks. The building portion includes a reconfigurable building surface defined by a series of building or connection posts configured move with respect to the building surface. Specifically, the building posts selectively telescope into and out of the building portion from a retracted post position to an extended post position, and vice versa. The building or accessory block, which mates with the building post, may also include a displaceable boss. In operation, the accessory block is coupled to a building post on the building surface. As the building post moves, it causes a corresponding motion in the boss of the accessory block.

BRIEF DESCRIPTION OF THE DRAWINGS

FIG. 4A illustrates a cross sectional view of the block and FIG. 4B illustrates a bottom perspective view of the block.

Like reference numerals have been used to identify like elements throughout this disclosure.

DETAILED DESCRIPTION OF THE INVENTION

Figure 1:
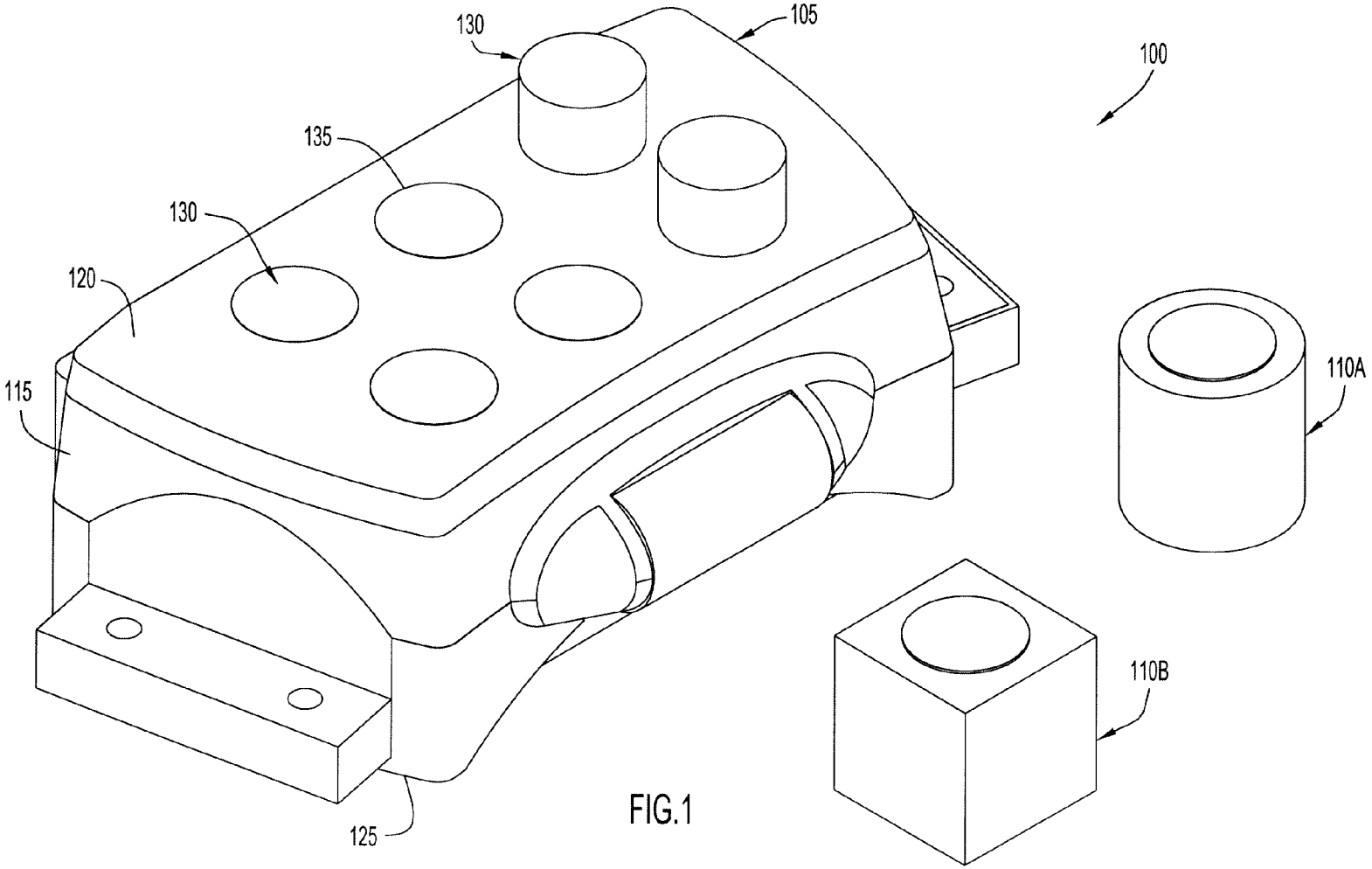
FIG. 1 illustrates a front perspective view of a toy building system in accordance with an embodiment of the invention.

Referring to FIG. 1, the toy building system 100 according to the present invention includes a building portion or base

105 and one or more accessory blocks 110A, 110B (also called play components). The base 105 includes a housing 115 defining a first or building surface 120 that receives the blocks 110A, 110B and a second or support surface 125 that contacts a supporting surface. By way of example, the building surface 120 of the base 105 may define a generally horizontal surface oriented in spaced parallel relation from the second surface 125.

The base 105 houses one or more building or connection posts 130, each connection post 130 defining a male engagement member operable to mate with a female receptacle on a corresponding block 110A, 110B. Each connection post 130 is associated with aperture 135 formed into the building surface 120. Each aperture 135 possesses a diameter slightly larger than the diameter of its corresponding connection post 130; moreover, each aperture is contoured to the exterior surface of the post 130. Consequently, each connection post 130 passes through its associated aperture 135. In the embodiment illustrated in FIG. 1, the building surface 120 includes three rows of apertures 135, each aperture 135 accommodating an individual connection post 130.

Figure 2:
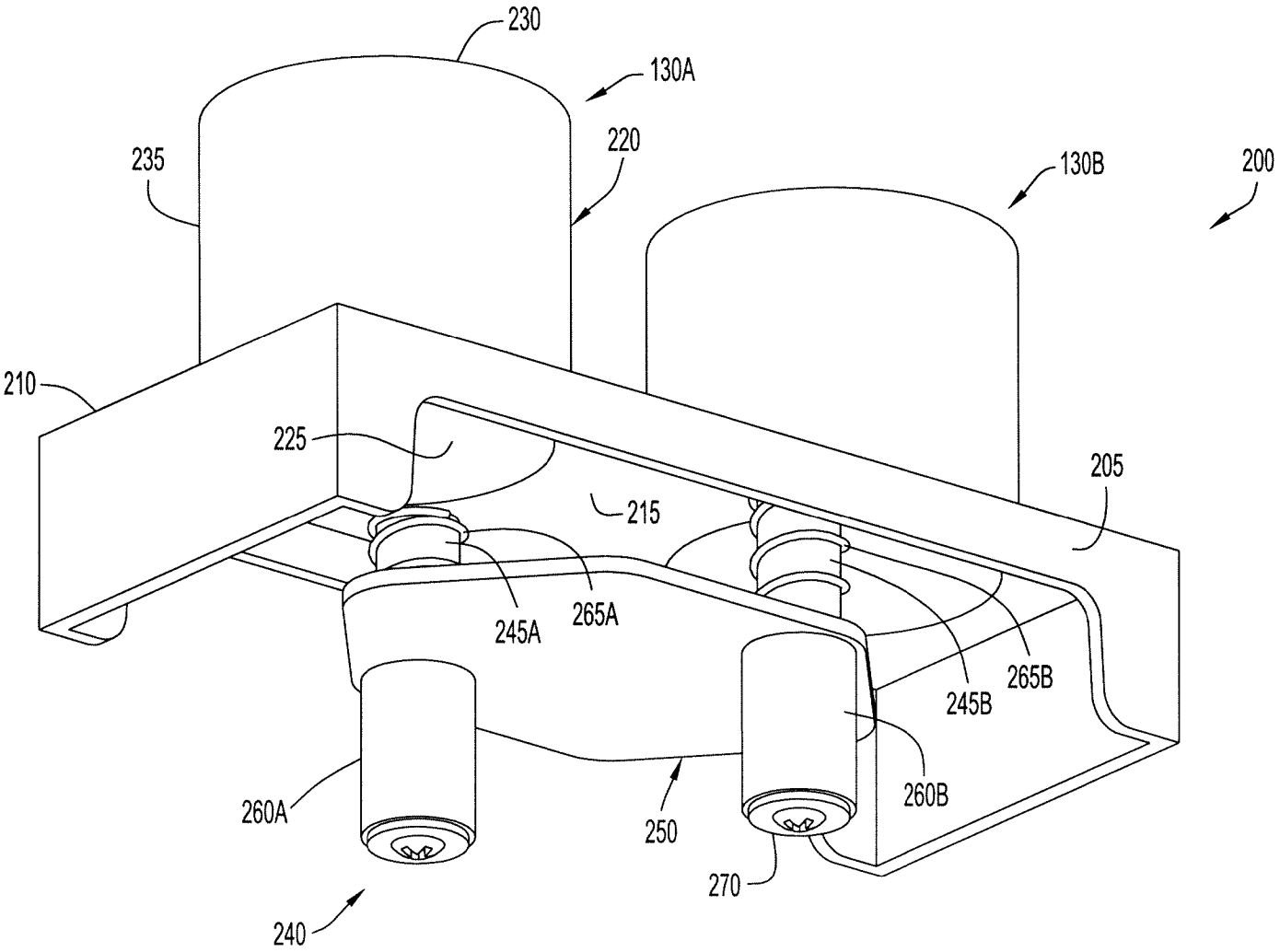
FIG. 2 illustrates an isolated, bottom perspective view of a connection post assembly.

Each connection post 130 may form a component of a connection post assembly. FIG. 2 shows a connection post assembly 200 in accordance with an embodiment of the invention. As illustrated, a connection post assembly 200 includes a platform 205 and one or more connection posts 130A-130B extending from the platform 205. The platform 205 may be generally planar element having a first or upper surface 210 and an opposed second or lower surface 215. The connection posts 130A-130B include a body 220 defining a proximal end 225, a distal end 230, and a sidewall 235 extending between the distal and proximal ends. By way of example, each connection post 130A-130B may be in the form of a hollow cylinder having an opened proximal end 225, a closed distal end 230, and a curved sidewall 235. The number of connection posts 130A-130B forming the assembly is not particularly limited. In the embodiment illustrated, the connection post assembly 200 includes a forward connection post 130A and a rearward post 130B oriented in spaced relation from the forward connection post 130A.

The connection post assembly 200 may further include a recoil mechanism operable to dampen mechanical shocks applied to the connection posts. As shown in FIG. 2, the recoil mechanism 240 includes a first rod or piston 245A angularly spaced from a second rod or piston 245B. The rods 245A, 245B extend distally from the lower surface 215 of the platform 205. A carriage 250 including a first sleeve 260A and a second sleeve 260B is slidingly coupled to the rods 245A, 245B. A biasing member 265A, 265B (e.g., a spring), coiled around each rod 245A, 245B, is configured to return the carriage 250 to a normal, uncompressed position. Stop members 270 may secure the carriage 250 to the rods 245A, 245B In operation, the connection post assembly 200 begins in its normal, expanded position, orienting the sleeves 260A, 260B in spaced relation from the lower surface 215 of the platform 205. When a downward force is applied to the connection post assembly 200, the carriage 250 slides axially along the rods 245A, 245B and toward the lower surface 215 of the platform 205, compressing the biasing member 265A, 265B. Upon removal of the force, the elastic force of the biasing member 265A, 265B returns the carriage 250 to its normal position.

The number of connection post assemblies 200 contained within the base 105 is not particularly limited. In the illustrated embodiment, the base 105 may include a first or left connection post assembly 200A, a second or middle connection post assembly 200B, and a third or right connection post assembly 200C (see FIG. 3A for example). As seen in the figures, the connection post assemblies 200A, 200B, 200C may be laterally spaced in generally parallel relation along the building surface 120.

The building surface 120 is dynamic, i.e., the connection pattern of the surface may be selectively altered to change its building configuration. Specifically, the connection posts 130A, 130B may be configured to move relative to the building surface 120, telescoping into and out of the housing. Each connection post 130A, 130B may selectively move from a first, retracted or lowered position, to a second, extended or raised position, and vice versa. In the retracted position, the distal end 230 of a connection post 130A, 130B is oriented at a first distance or height (h1) from the building surface 120. In the extended position, the distal end 230 of the connection post 130A, 130B is spaced a second distance or height (h2) from the building surface 120. The first height (h1) may be less than the second height (h2). By way of example, at the first height (h1), the distal end 230 of the connection post 130 is oriented generally flush or slightly inset into the building surface 120. At the second height h2, the distal end 230 is positioned above the building surface 120. Alternatively, the connection post 130A, 130B may be positioned above the building surface 120 in either position, with the first height (h1) being less than the second height (h2). As a result, the distance the connection post 130A, 130B extends out of the housing 105 and the building surface 120 varies, positioning the connection posts 130A, 130B in a predetermined orientation with respect to the building surface 120.

Figure 3A:
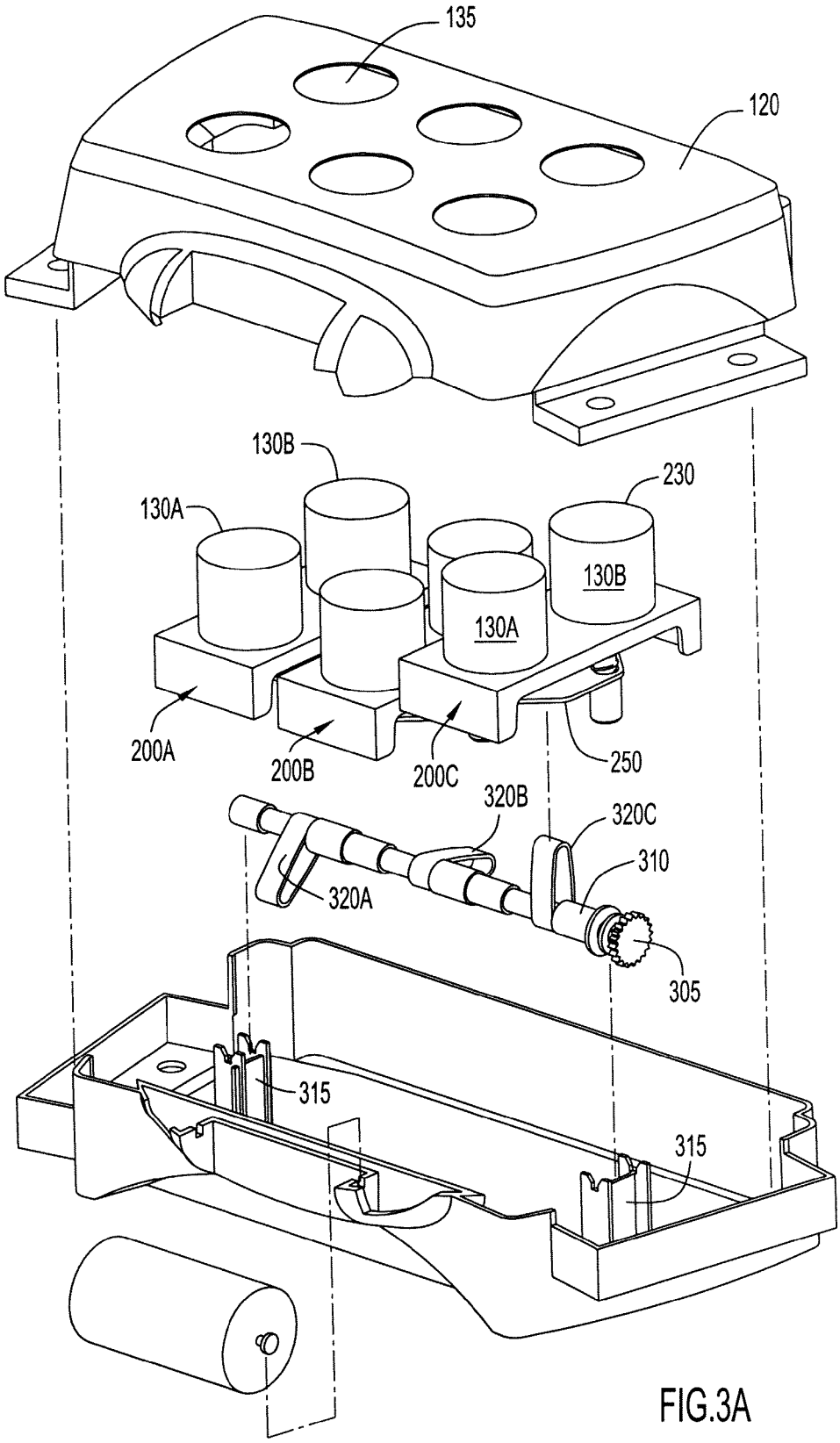
FIG. 3A illustrates an exploded view of a building portion of the toy building system of FIG. 1.

The movement of the connection posts 130A, 130B may be generated by a reorientation mechanism housed in the base 105. The reorientation mechanism may be configured to reciprocally drive each connection post assembly 200A, 200B, 200C between its first (retracted) position to its second (extended) position. Referring to FIG. 3A, the reorientation mechanism includes a gear 305 connected to a camshaft 310 oriented on a yoke or bearing 315. The gear 305 is in communication with a motor that rotates the camshaft 310 (motor not illustrated for clarity). The motor may be driven, e.g., by battery power. The camshaft 310 includes a cylindrical shaft with a plurality of lobes or cams 320A, 320B, 320C protruding radially therefrom. The cams 320A, 320B, 320C are spaced axially along the shaft 310 such that each cam generally aligns with the carriage 250 of one of the recoil mechanisms. The cams 320A, 320B, 320C, moreover, may be positioned at different angular positions around the perimeter of the camshaft 310. As a result, a cam 320A, 320B, 320C engages the underside of its corresponding carriage 250 at a different time compared to that of an adjacent cam and carriage.

Figure 3B:
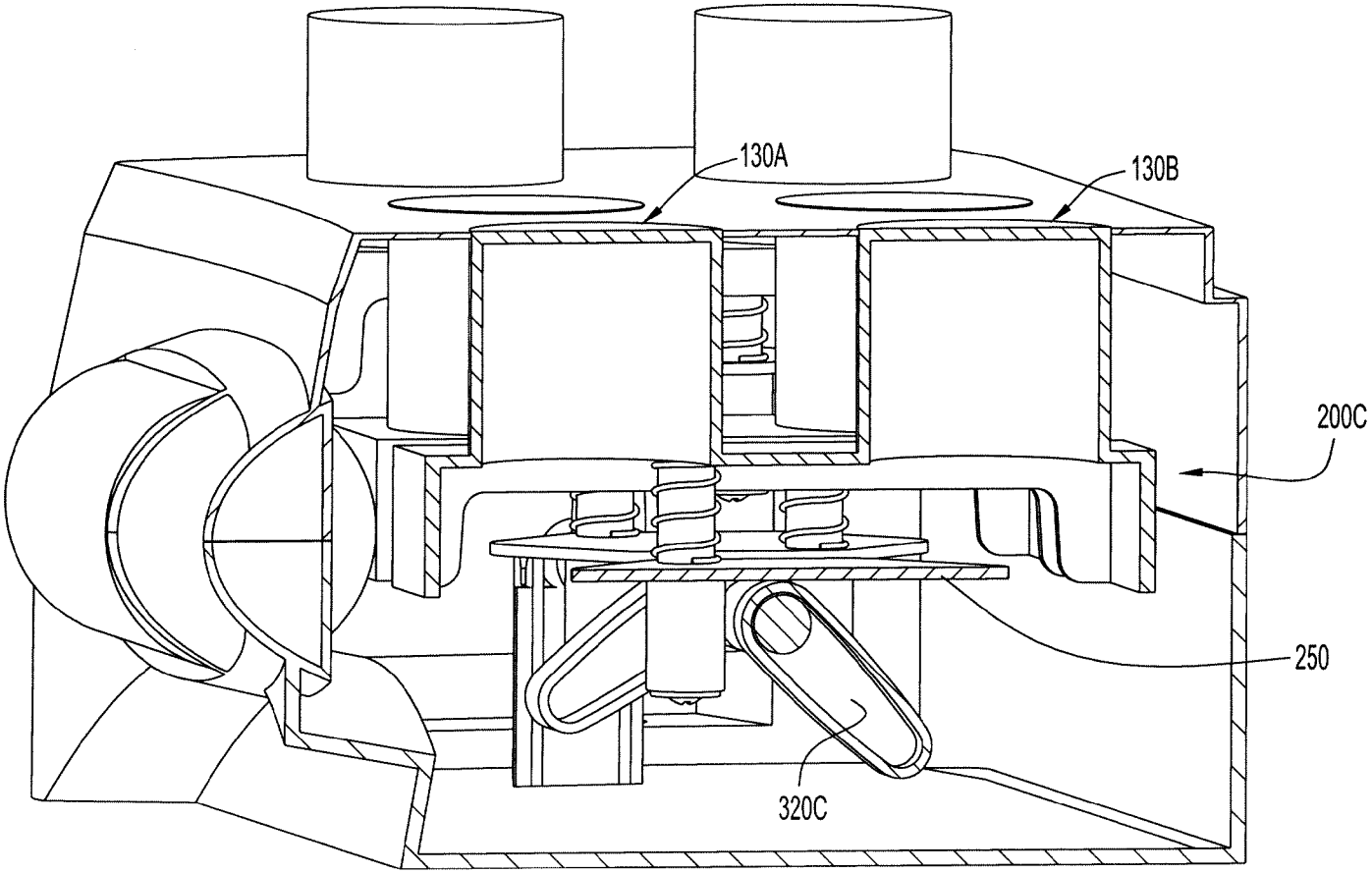
FIGS. 3B and 3C illustrate cross sectional views of the base of the toy building system of FIG. 1, showing the engagement of the camshaft with a connection post assembly.
Figure 3C:
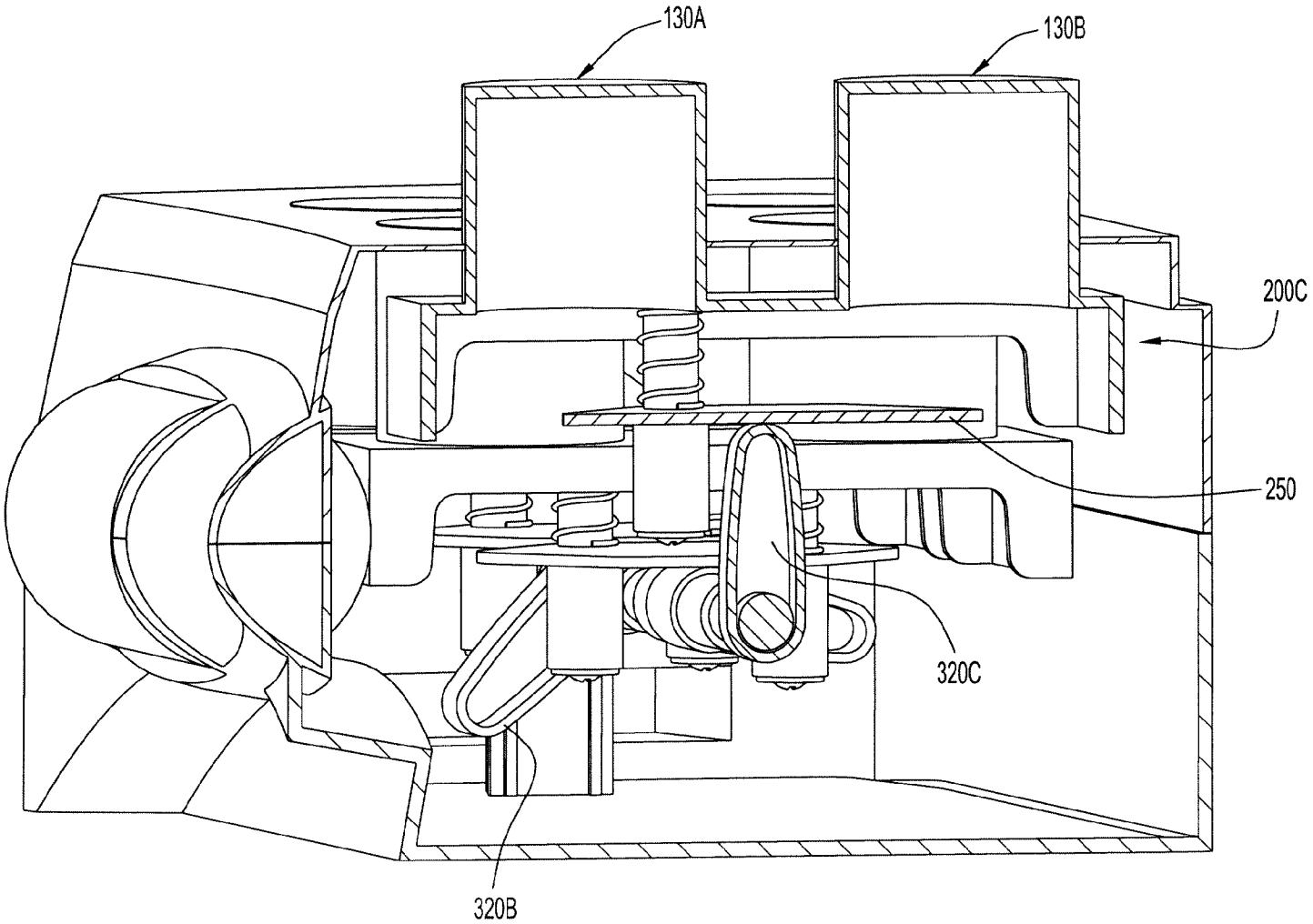

The operation of the reorientation mechanism is seen best in FIGS. 3B and 3C. The motor drives the gear 305 connected to the camshaft 310. The camshaft 310 rotates, in turn, rotating the cams 320A, 320B, 320C. Each cam 320A, 320B, 320C contacts its associated connection post assembly 200A, 200B, 200C (i.e., the carriage 250 of the assembly), gradually driving the carriage 250 upward. This, in turn, drives the connection posts 130A, 130B upward (through the aperture 135) from their first (retracted) position to their second (extended) position with respect to the building surface 120. After the connection posts 130A, 130B reach their apex, the cams 320A, 320B, 320C continue rotating, gradually lowering the connection posts 130A, 130B back to their nadir. In this manner, the rotational motion of the camshaft 310 produces a smooth, reciprocating or oscillating motion in each connection post assembly 200A, 200B, 200C.

With the above described configuration, the building configuration of the building surface 120 may be continually altered. Since the height of the connection posts 130A, 130B with respect to the building surface 120 changes, it alters the nature of the connection point and/or the number of connection points available to a user for block connection. By way of example, the building surface 105 could define a first building configuration, in which the extension height of one connection post 130A, 130B is equal to the extension height of another connection post. Alternatively, in a second building configuration, the extension height of one connection post 130A, 130B is not equal to the extension height of another connection post. For example, in the second building configuration, the height of one connection post 130A, 130B may be greater or less than the height of another connection post. In still other configurations, the first connection post assembly 200A may be available for block connection since it extends above the building surface 120, but the second connection post assembly 200B may be inset into the building surface 120, preventing block connection thereto.

Figure 4A:
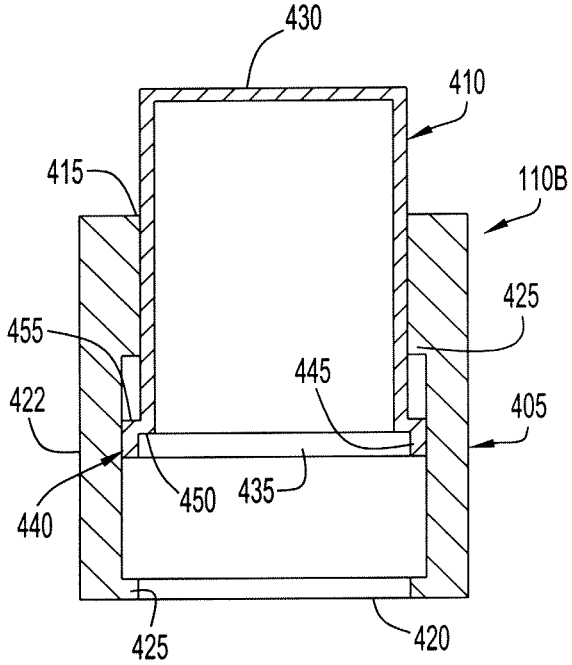
FIGS. 4A and 4B illustrate an accessory block in accordance with an embodiment of the invention. Specifically.
Figure 4B:
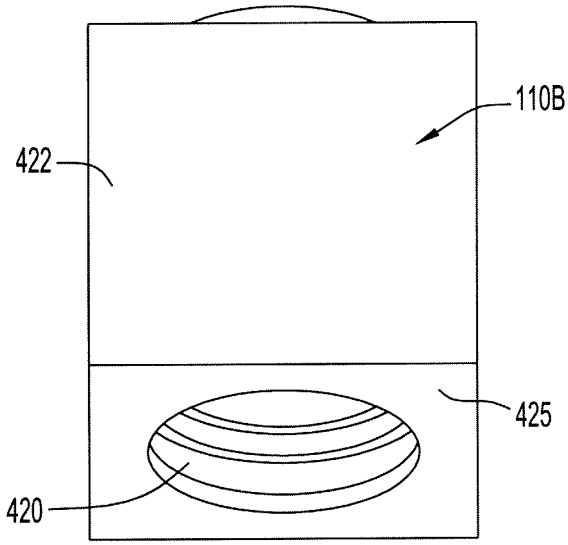

Each accessory block 110A, 110B is a play component adapted to couple to the connection post 130A, 130B. FIG. 4A is a cross-sectional view of an accessory block in accordance with an embodiment of the invention, while FIG. 4B is a bottom perspective view of the block of FIG. 4A. As shown, a block 110A, 110B includes a body or shell 405 and a displaceable boss 410 captured within the shell. The shell 405 may include an upper opening 415, a lower opening 420, and a side wall 422. The upper 415 and lower 420 openings may be defined by a lip or rim 425 extending transversely from the sidewall 422. The lower opening 420, moreover, may be generally coaxial with the upper opening 415 to define a central passageway through which the boss 410 travels. The shell 405 and the openings 415, 420 may possess any suitable shape or dimensions. By way of example, the shell 405 may possess a hollow, generally cylindrical or generally cubic shape with generally annular openings 415, 420.

The boss 410 may be in the form of a hollow shaft having an upper or distal end 430 and a lower or proximal end 435. The proximal boss end 435 includes a receptacle 440 operable to mate with the distal end 230 of the connection post 130A, 130B. Specifically, the proximal boss end 435 includes a flange 445 defining an interior boss shoulder 450 and an exterior boss shoulder 455. The interior shoulder 450 is configured to engage the distal end 230 of a connection post 130 or the distal end 430 of a boss 410 from another block (discussed in greater detail below).

The boss 410 may be movable relative to the shell 405. By way of example, the boss 410 may be configured to telescope outward from a first, lowered boss position to a second, raised boss position. In the lowered position, the distal end 430 of the boss 410 is disposed at a first distance (d1) from the upper surface of the shell, e.g., the distal boss end 430 may be positioned slightly above the upper opening 415. In the raised position, the distal boss end 430 is disposed at a second distance (d2) from the shell surface greater than the first distance (thus, d1 is less than d2).

In the lowered position, the flange 445 of the boss 410 may rest on the rim 425 of the lower opening 420. In the extended position, the exterior shoulder 455 of the boss 410 may engage the rim 425 of the upper opening 415. As a result, the rims 425 act as stops that prevent over-extension or over-retraction of the boss 410 with respect to the shell 405. In operation, a connection post 130A, 130B is axially received into the boss receptacle 440 such that the distal end 230 of the connection post engages the interior shoulder 450, displacing the boss 410 and driving it upward.

Figure 5A:
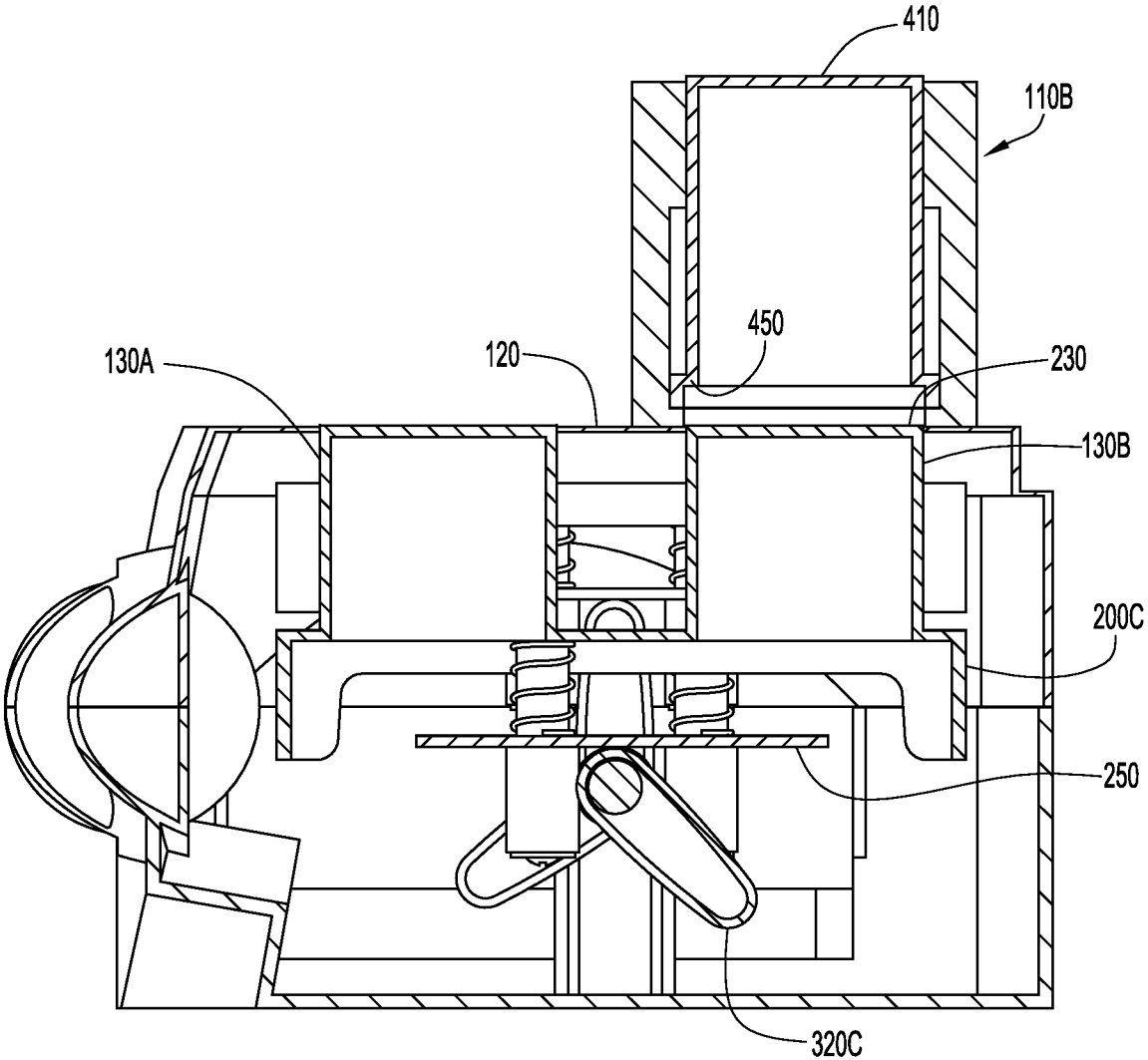
FIGS. 5A and 5B illustrate cross sectional side views of the building portion of the system of FIG. 1 with an accessory block coupled thereto, showing an interaction between the block and the dynamic building surface.
Figure 5B:
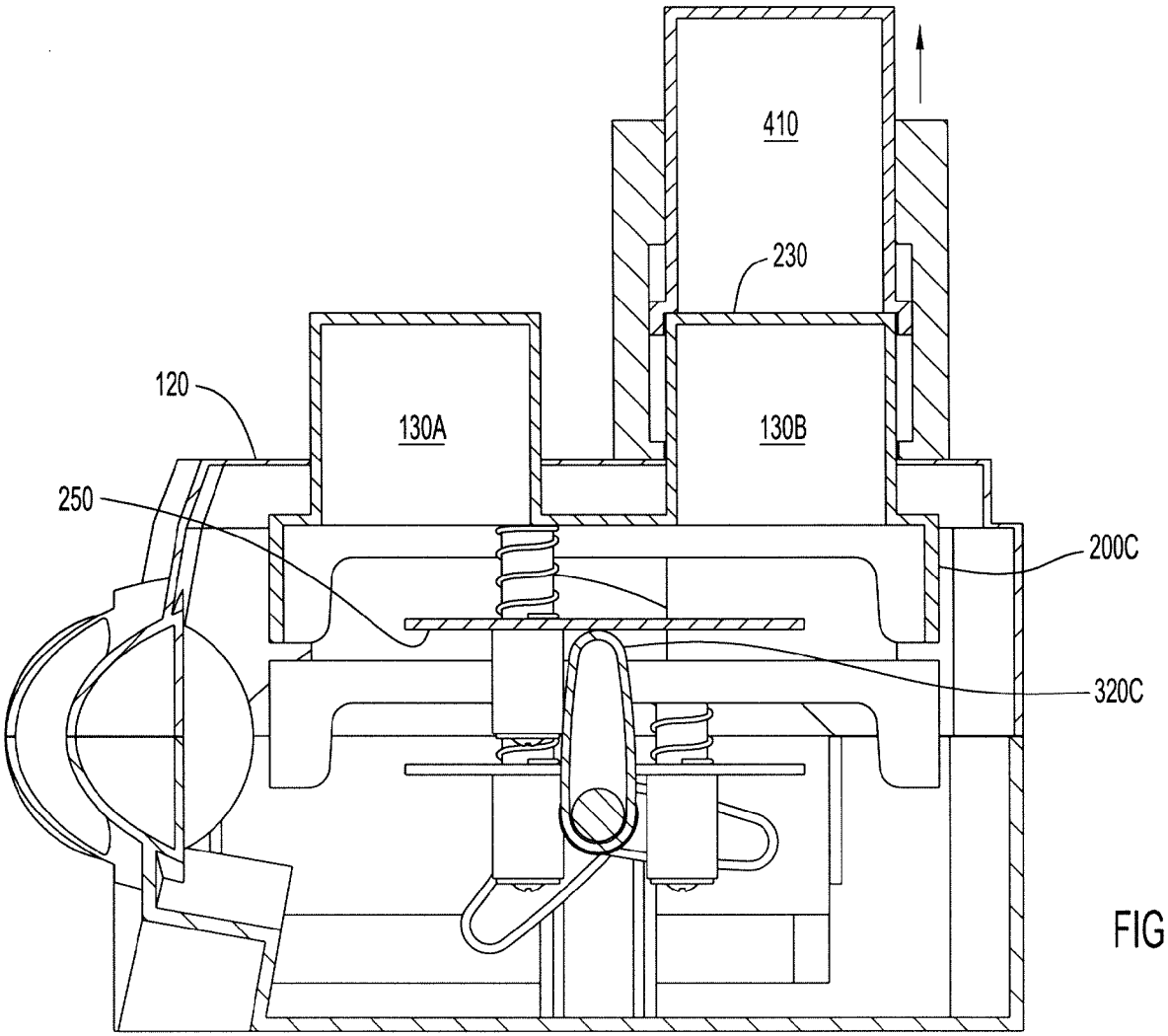

The interaction between the building surface 120 and the accessory block 110A, 110B is explained with reference to FIGS. 5A, 5B and 6A, 6B. A block 110A, 110B is placed on the building surface 120 of the base 105, being positioned over a connection post 130A, 130B such that the post is generally coaxial with a boss 410. Referring to FIG. 5A, the connection post 130A, 130B is oriented in its retracted post position and the boss 410 is oriented in its lower boss position. Engaging the motor (e.g., via an actuator) rotates the camshaft 310 as described above. Each cam 320A, 320B, 320C individually engages its associated carriage 250 of the connection post assembly 200A, 200B, 200C, driving the assembly upward to move it from the first (retracted) position to the second (extended) position. As shown in FIG. 5B, the connection post 130A, 130B moves upward, its distal end 230 engages the receptacle 440 of the boss 410, driving the boss upward (indicated by arrow). As the camshaft 310 completes its rotation, the connection posts 130A, 130B are lowered back to the first position, lowering the boss 410. This process may continue at predetermined intervals, producing reciprocal movement of the connection posts 130A, 130B, which, in turn, causes a corresponding reciprocal movement in the boss 410. This movement is coaxial. That is, the connection post 130A, 130B and the boss 410 are driven along the same axis.

Figure 6A:
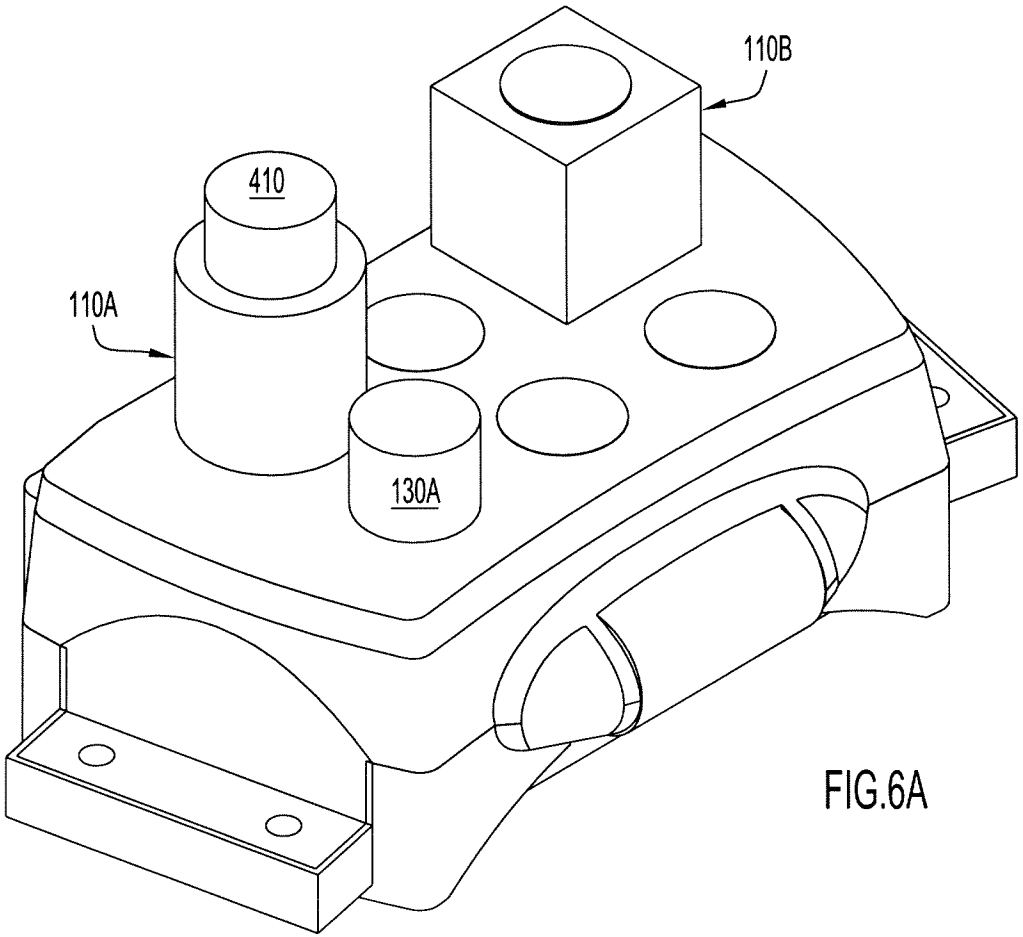
FIGS. 6A-6C illustrate the operation of the dynamic building surface in accordance with an embodiment of the invention, showing a successive movement of connection posts with respect to the building surface.
Figure 6B:
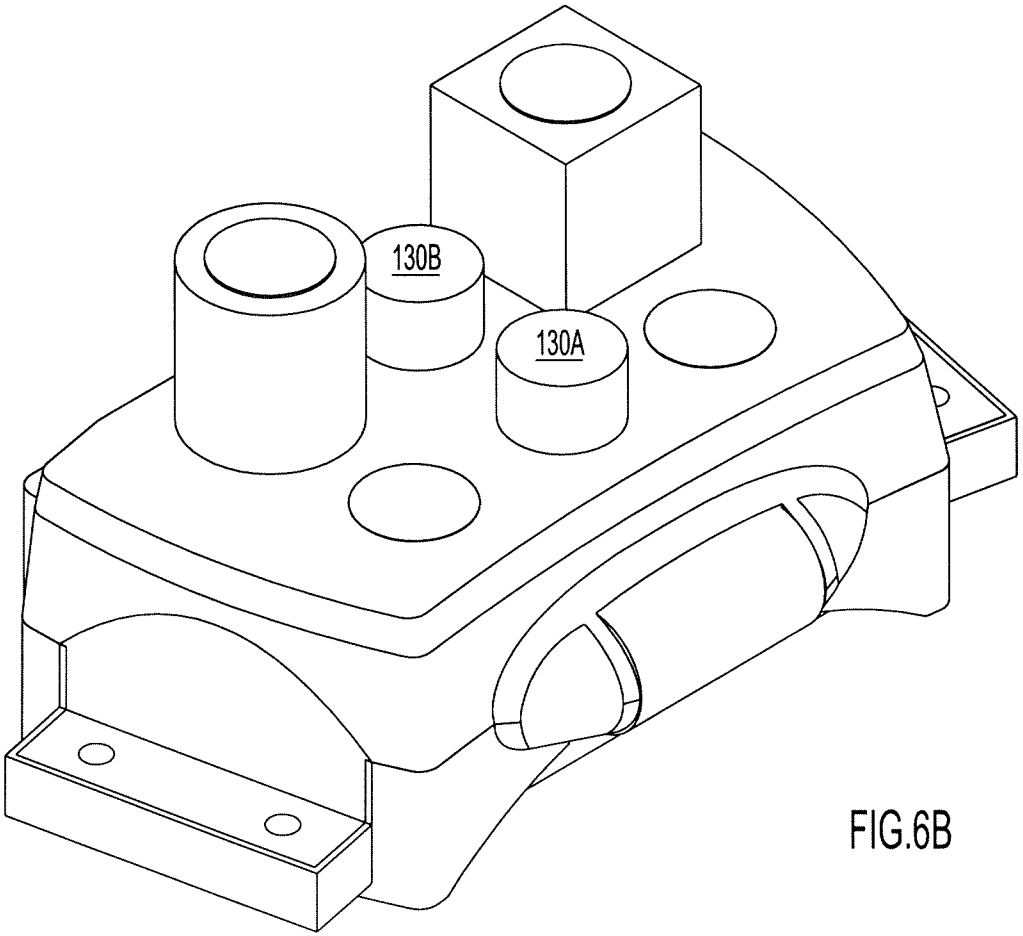
Figure 6C:
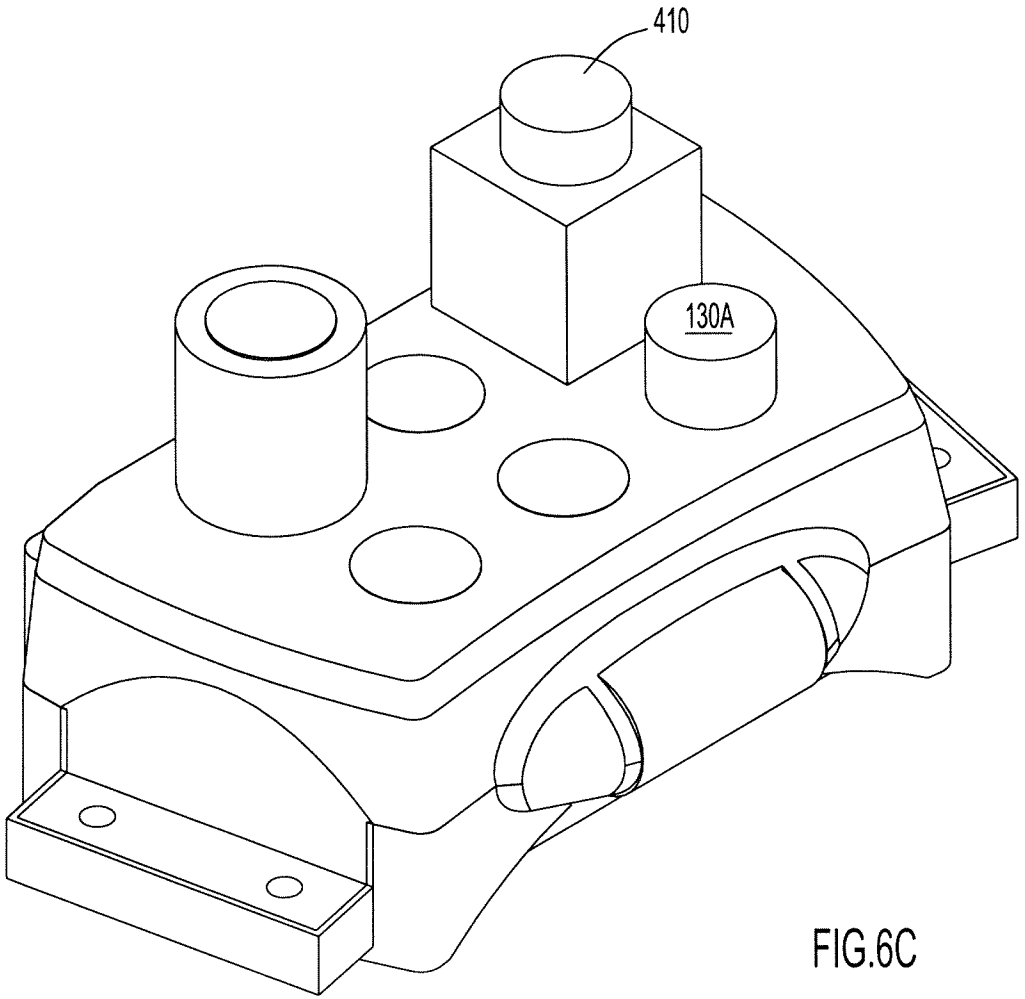

As the reorientation mechanism continues, it may repeatedly engage each of the first connection post assembly 200A (FIG. 6A), the second connection post assembly 200B (FIG. 6B), and then the third connection post assembly 200C (FIG. 6C). Thus, placing the accessory blocks 110A, 110B at predetermined connection post positions (e.g., such that the boss is generally coaxial with the connection posts 130) causes block motion that is selectively engaged as the connection post assemblies 200A, 200B, 200C are engaged. This results in a dynamic building surface. Not only are the connection posts 130A, 130B in motion, but also the bosses 410 of the blocks 110A, 110B connected to the connection post 130A, 130B are in motion.

Figure 7:
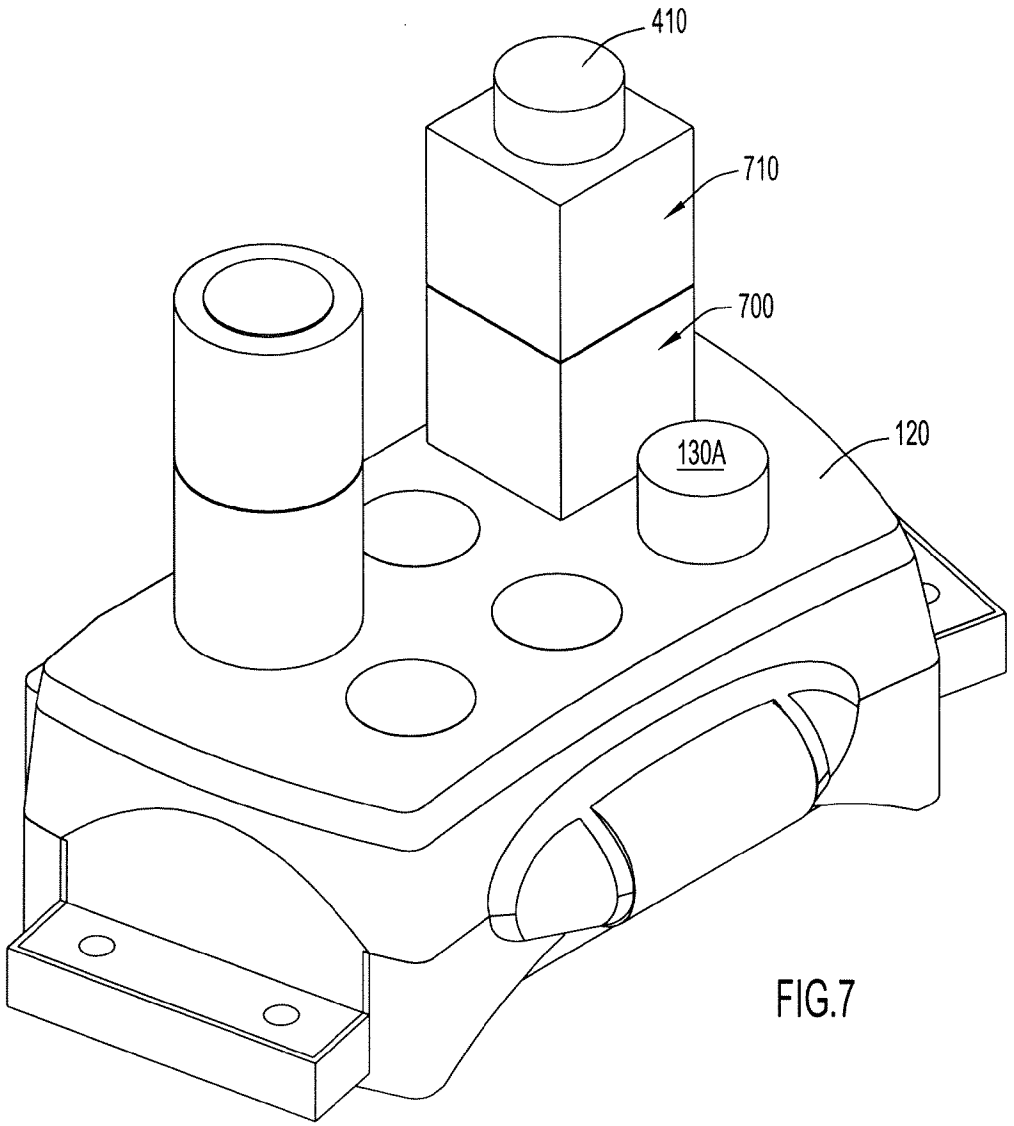
FIG. 7 illustrates the building system of FIG. 6C, further including secondary accessory blocks coupled to primary accessory blocks in communication with the building surface.

In addition, the blocks 110A, 110B may be coupled to one another such that the motion of the connection posts 130A, 130B is transferred through connected blocks. As shown in FIG. 7, a first block 700 is positioned on the building surface 120 as described above. A second block 710 coupled to the first block 700 such that boss 410 on the first (lower) block engages the boss receptacle 440 of the second (upper) block 710. As a result, the motion of the connection post 130A, 130B is transferred not only to the first block 700, but also to the second block 710 mated with the first block.

Thus, the present invention provides a building playset including a building portion and a play component. The building portion includes a building surface and a dynamic building member that moves with respect to the building surface such that the distance that the building member extends from the surface varies. By way of example, the building component is placeable in a first position, in which the building component extends outward from the building surface a first distance, and a second position, in which the building component extends outward from the building surface a second distance (e.g., the second distance being greater than the first distance). As a result, since the building component and the surface define a configuration of the building portion, the configuration of the building portion being changeable during play. That is, the configuration of the building portion continually changes during play without any interaction by a user.

As described above, the play component is engageable with the building component. Specifically, the play component includes a body with a central passageway and a movable object placed in the central passageway, the movable object being movable relative to the body such that the movable object can extend outward from the body, the movable object being engaged by the building component when the play component is placed on the building component.

While the invention has been described in detail and with reference to specific embodiments thereof, it will be apparent to one skilled in the art that various changes and modifications can be made therein without departing from the spirit and scope thereof. For example, the device may further include an electronics assembly operable to generate sensory output such as audio output (songs, sound effects, etc.) and visual output (e.g., lights). While blocks with displaceable bosses are illustrated, the playset may include blocks with static bosses. The blocks 110A, 110B may further include an image hidden while the boss 410 is in its retracted position, but is revealed in its extended position.

In addition, the connection posts 130 may be individually or collectively engaged. Thus, the connection posts 130 may be singly engaged, may be engaged in pairs (as illustrated), or may be engaged in any other suitable number (e.g., in triplets). The connection post 130 may be engaged such that a first connection post extends from the building surface at a distance that is equal to the distance a second connection post extends from the building surface. In addition, one connection post may extend from the base at a distance that differs from another connection post. The reorientation mechanism may be any suitable for its described purpose, e.g., to move a first building post and a second building post relative to the housing such that the distances that the first building member and the second building member extend from the housing vary. The motor driving the reorientation, moreover, is not particularly limited.

Thus, it is intended that the present invention cover the modifications and variations of this invention that come within the scope of the appended claims and their equivalents. It is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration.

We claim:

1. A building toy comprising:

a building portion comprising:

a housing with a building surface, and a first connection post moveably coupled to the housing, the first connection post having a proximal portion and a distal portion, the first connection post being extendable from the housing and movable relative to the building surface such that the distal portion of the first connection post extends from the housing at varying distances from the building surface;

a second connection post moveably coupled to the housing, the second connection post having a proximal portion and a distal portion, the second connection post being extendable from the housing and movable relative to the building surface such that the distal portion of the second connection post extends from the housing at varying distances from the building surface, wherein the second connection post moves independently of the first connection post; and a block configured to couple to at least one of the first connection post and the second connection post, the block comprising a body with a passageway and a boss movable relative to the body along the passageway, wherein collective positions of the first and second connection posts with respect to the building surface define a building configuration, and wherein the building configuration of the building portion is selectively changeable during play via movement of one or both of the connection posts, and wherein the first connection post is configured to interlock with the boss such that movement of the first connection post generates boss movement.

2. The building toy of claim 1, wherein:

the first connection post extends outward from the building surface at a first extension height;

the second connection post extends outward from the building surface at a second extension height; and the building portion includes a first building portion configuration, in which the first extension height of the first connection post is equal to the second extension height of the second connection post, and a second building portion configuration, in which the first extension height of the first connection post is not equal to the second extension height of the second connection post.

3. The building toy of claim 2, wherein, in the second building portion configuration, the first extension height of first connection post is less than the second extension height of the second connection post.

4. The building toy of claim 2, wherein the building portion includes a drive mechanism in communication with each of the first connection post and the second connection post, the drive mechanism moving the first and second connection posts relative to the building surface of the building portion.

5. The building toy of claim 1, wherein the building configuration of the building portion continually changes during play without any interaction by a user.

6. A toy building assembly, comprising:

a housing having a plurality of walls defining an interior region, one of the walls having an outer surface;

a first building member and a second building member both coupled to the housing, the building members being movable relative to the outer surface and extendable therefrom;

a drive mechanism including a motor, the drive mechanism being disposed in the interior region of the housing, wherein the drive mechanism drives the first and second building members with respect to one another to move the building members relative to the outer surface; and a block member comprising a body and a boss telescopically coupled to the body, wherein the block member couples to one of the building members such that movement of the one building member generates boss movement.

7. The toy building assembly of claim 6, wherein:

the block member is a first block member, and the assembly further comprises:

a second block member, the second block member including a body and a boss telescopically coupled to the body, wherein the second block member couples to the other of the building member members.

8. The toy building assembly of claim 6 wherein the drive mechanism moves the first building member and the second building member relative to the housing such that distances the first building member and the second building member extend from the housing vary.

9. The toy building assembly of claim 6, wherein the drive mechanism moves the first and second building members relative to the outer surface automatically.

10. A building toy comprising:

a building portion including:

a housing defining a building surface, wherein the building surface comprises an opening, and a building post received within the housing, wherein the building post is movably coupled to the housing such that building post travels through the opening, moving from a first building post position to a second building post position, and wherein the building post comprises a recoil mechanism operable to resiliently drive the building post to a predetermined position; and a block accessory configured to mate with the building post, the block accessory including:

a shell, and a boss telescopically coupled to the shell such that the boss moves from a first boss position to a second boss position, wherein movement of the building post from the first building post position to the second building post position causes a corresponding movement in the boss from the first boss position to the second boss position.

11. The building toy of claim 10, wherein:

the boss is generally coaxial with the building post when mated thereto; and the building post and the boss move along the same axis.

12. The building toy of claim 11, wherein:

the building post comprises a proximal end, a distal end, and a side wall; and the boss comprises:

a body having a proximal end, a distal end, and a side wall, and a receptacle disposed along the proximal boss end, the receptacle configured to receive the distal end of the building post.

13. The building toy of claim 12, wherein the recoil mechanism includes a carriage slidably coupled to the building post and a biasing member that biases the building post such that it is oriented in spaced relation from the carriage.

14. The building toy of claim 10, wherein:

the opening is a first opening;

the building post is a first building post;

the building surface further comprises a second opening; and the building portion further comprises:

a second building post received within the housing, wherein the second building post is movably coupled to the housing such that second building post travels through the second opening such that the second building post moves from a first position to a second position, and a reorientation mechanism housed within the building portion, the reorientation mechanism being operable to independently drive each building post to reorient the first and second building posts from their respective first position to their respective second position.

15. The building toy of claim 10 further comprising a reorientation mechanism operable to drive the building post from the first building post position to the second building post position.

16. The building toy of claim 14, wherein the reorientation mechanism includes a camshaft with a plurality of cams configured to selectively engage the building posts such that the rotary motion of the cam generates a translating motion in the building posts in a direction generally orthogonal to the building surface.

17. The building toy of claim 10, wherein:

the building portion comprises a plurality of building posts, each post adapted to mate with the block accessory;

the building posts are each positioned with respect to the building surface in a predetermined orientation to define a building configuration;

the building portion houses a reorientation mechanism operable to selectively reorient the building posts with respect to the building surface, altering the building configuration from a first building configuration to a second building configuration.

18. The building toy of claim 17, wherein the reorientation mechanism continuously alters the building configuration of the building surface during play.

19. The toy building assembly of claim 6, wherein the building member further comprises a recoil mechanism including a carriage slidably coupled to the building member and a biasing member operable to bias the building member such that it is oriented in spaced relation from the carriage.

20. The building toy of claim 1, further comprising a reorientation mechanism operable to extend the connection posts from the housing; the reorientation mechanism including a camshaft with a first cam in communication with the first connection post and a second cam in communication with the second connection post, wherein the camshaft is configured to rotate, and wherein rotary motion of the cam generates a translating motion in the connection posts in a direction generally orthogonal to the building surface.

21. The building toy of claim 20, wherein:

each of the first and second connection posts comprise a recoil mechanism including a carriage slidably coupled to the connection post and a biasing member operable to bias the building member such that it is oriented in spaced relation from the carriage; and the reorientation mechanism is rotated by an electric motor.

22. The building toy of claim 1, wherein the second connection post is configured to interlock with the boss such that movement of the second connection post generates boss movement.

23. The building toy of claim 1, wherein:

the boss comprises a proximal portion and a distal portion; and the proximal portion of the boss defines an opening adapted to receive the distal portion of the first connection post.

24. The building toy of claim 1, wherein:

the boss comprises a proximal portion and a distal portion; and the connection post distal portion is received by the boss proximal portion.

25. A toy building assembly, comprising:

a housing having a plurality of walls defining an interior region, one of the walls having an outer surface;

a building member coupled to the housing, the building member being movable relative to the outer surface and extendable therefrom;

a drive mechanism including a motor, the drive mechanism being disposed in the interior region of the housing, wherein the drive mechanism drives the building member to move the building member relative to the outer surface;

a block member comprising a body and a boss telescopically coupled to the body, wherein the block member couples to the building member such that movement of the building member generates boss movement, and wherein the building member further comprises a recoil mechanism including a carriage slidably coupled to the building member and a biasing member operable to bias the building member such that it is oriented in spaced relation from the carriage.

* * * * *